US008532324B2

(12) United States Patent
Oosato et al.

(10) Patent No.: US 8,532,324 B2
(45) Date of Patent: Sep. 10, 2013

(54) HEADPHONE

(75) Inventors: Yuusuke Oosato, Tokyo (JP); Koji Nageno, Tokyo (JP)

(73) Assignee: Sony Corporation, Tokyo (JP)

( * ) Notice: Subject to any disclaimer, the term of this patent is extended or adjusted under 35 U.S.C. 154(b) by 978 days.

(21) Appl. No.: 12/075,521

(22) Filed: Mar. 12, 2008

(65) Prior Publication Data

US 2008/0273737 A1 Nov. 6, 2008

(30) Foreign Application Priority Data

Mar. 13, 2007 (JP) ..... 2007-063989

(51) Int. Cl.
*H04R 1/00* (2006.01)

(52) U.S. Cl.
USPC ..... 381/371; 381/370; 381/380

(58) Field of Classification Search
USPC ..... 381/370, 380, 315, 72, 322
See application file for complete search history.

(56) References Cited

U.S. PATENT DOCUMENTS

| | | | | |
|---|---|---|---|---|
| 4,668,842 | A * | 5/1987 | Yokoyama et al. | 381/380 |
| 5,333,206 | A * | 7/1994 | Koss | 381/370 |
| 5,519,782 | A * | 5/1996 | Shinohara et al. | 381/370 |
| 5,781,638 | A * | 7/1998 | Hosaka et al. | 381/322 |
| 5,949,896 | A * | 9/1999 | Nageno et al. | 381/328 |
| 6,105,714 | A | 8/2000 | Lindgren | |
| 6,868,164 | B2 * | 3/2005 | Ito et al. | 381/370 |
| 7,110,563 | B2 * | 9/2006 | Bergere | 381/380 |
| 2005/0008184 | A1 * | 1/2005 | Ito et al. | 381/370 |
| 2005/0069145 | A1 * | 3/2005 | Sjoqvist | 381/72 |
| 2006/0120546 | A1 * | 6/2006 | Tanaka et al. | 381/315 |
| 2010/0046782 | A1 | 2/2010 | Ito et al. | |

FOREIGN PATENT DOCUMENTS

| | | | |
|---|---|---|---|
| JP | 48-023736 | U | 7/1973 |
| JP | 56-167688 | U | 12/1981 |
| JP | 56-172082 | U | 12/1981 |
| JP | 57-170691 | U | 10/1982 |
| JP | 58-082089 | U | 6/1983 |
| JP | 59-088992 | U | 6/1984 |
| JP | 60-108093 | U | 7/1985 |
| JP | 60-178798 | A | 9/1985 |
| JP | 61-042186 | U | 3/1986 |
| JP | 05- 020493 | U | 3/1993 |
| JP | 05-207579 | A | 8/1993 |
| JP | 06-054391 | | 2/1994 |
| JP | 06-054391 | A | 2/1994 |
| JP | 06-081196 | U | 11/1994 |
| JP | 07- 327291 | A | 12/1995 |
| JP | 2000-201390 | A | 7/2000 |
| JP | 2001-506874 | A | 5/2001 |
| JP | 2001-197581 | A | 7/2001 |
| JP | 2002-176689 | A | 6/2002 |
| JP | 2003-102082 | A | 4/2003 |

(Continued)

*Primary Examiner* — Duc Nguyen
*Assistant Examiner* — Phan Le
(74) *Attorney, Agent, or Firm* — Wolf, Greenfield & Sacks, P.C.

(57) ABSTRACT

A headphone including a housing that includes a speaker unit, and a protruding portion, provided at a specified area of one surface of the housing, that outputs playback sound generated from the speaker unit. When being worn on the head, the one surface of the housing comes in to contact with an outward facing surface of an auricle surrounding a cavity of a concha, and the protruding portion is inserted in to the cavity of the concha.

9 Claims, 11 Drawing Sheets

(56) References Cited

FOREIGN PATENT DOCUMENTS

| | | | |
|---|---|---|---|
| JP | 2003-179990 | A | 6/2003 |
| JP | 3610618 | | 10/2004 |
| JP | 2007-336432 | A | 12/2007 |

* cited by examiner

HEADPHONE

CROSS REFERENCES TO RELATED APPLICATION(S)

The present invention contains subject matter related to Japanese Patent Application JP 2007-063989 filed in the Japan Patent Office on Mar. 13, 2007, the entire contents of which being incorporated herein by reference.

BACKGROUND OF THE INVENTION

1. Field of the Invention

The invention relates to a headphone.

2. Description of the Related Art

Headphones include housings with built-in speaker units that output a playback sound, and a band that is connected to the housings.

Housings, depending on their size and their position in relation to an auricle 10 of the human ear, are classified into circumaural housings, supra-aural housings, intra-concha housings, insert housings and so on. With reference to the general view of the auricle 10 shown in FIG. 10, circumaural housings are formed to cover the whole of the auricle 10, while supra-aural housings are smaller than circumaural housings, and are shaped to form contact with the outward facing surface of the auricle 10. Intra-concha housings are inserted into a cavity of a concha 12 of the auricle 10, and are held in place with a tragus 14 or an antitragus 16. Insert housings are inserted into an external auditory canal 18, and have a form that allows them to be held in place in the same way as an earplug.

In particular, in order to ensure the housings are well balanced in circumaural and supra-aural headphones, the housings are held in place by, for example, a belt-shaped band that is connected to the housings. The band of a neckband is passed around the occipital region of the head, and the band of a headband is passed over the parietal region of the head.

A known headphone with an intra-concha housing is disclosed, for example, in Japanese Patent Application Publication No. JP-A-6-54391. The housing is formed with a shape that inhibits dulling of low-medium level sound.

SUMMARY OF THE INVENTION

It is to be noted that normally, a supra-aural housing and a circumaural housing have a flat shaped surface on the side that outputs playback sound, namely, the surface that faces the auricle 10. As a result, with a supra-aural housing or a circumaural housing, in order to hold headphone in position with respect to the head, a structure is adopted that uses elastic force toward an inner side of a neckband or a headband, and frictional force with the temporal region of the head or the auricle 10.

However, methods that use elastic force and frictional force to hold the headphone suffer from the problem that movement or the like of the person wearing the headphone may cause the position of the headphone to deviate.

Furthermore, because the surface of the housing on the side of the auricle 10 is flat, when the headphone is being worn, the distance between the housing and the concha 12 increases. As a result, sound that is played back from the housing may be lost between the housing and the concha 12, thus causing response to be impaired.

The present invention addresses the above-identified problems and provides a new and improved headphone that inhibits movement of a housing, improves stability of the headphone when worn, and improves sound sensitivity.

According to an embodiment of the present invention, a headphone is provided that includes: a housing that includes a speaker unit, and a protruding portion that is provided so as to protrude at a specified position on one surface of the housing and that outputs a playback sound generated from the speaker unit. When the headphone is worn on a head, the one surface of the housing comes into contact with an outward facing surface of an auricle surrounding a cavity of a concha, and the protruding portion is inserted in to the cavity of the concha.

According to the present structure, the protruding portion is provided in the one surface of the housing, and the protruding portion is inserted in to the cavity of the concha of the ear when the headphone is being worn. Thus, movement of the housing is inhibited. In addition, sound is output from the protruding portion and thus loss of sound between the housing and the concha can be reduced, thereby improving sound sensitivity.

The protruding portion may be provided such that, when the headphone is worn on the head, the protruding portion is at a lower side of the housing and in a section of the housing that is toward the rear of the head when the viewed from an insertion direction in which the protruding portion is inserted in to the cavity of the concha. According to this structure, when the protruding portion is inserted in the cavity of the concha, the housing can be worn in a well balanced manner on the head.

The protruding portion may be formed of an elastic material. If this structure is adopted, the housing feels more flexible when worn, and the housing can be held in place in the cavity of the concha by the elasticity. The protruding portion may be formed of one of silicon resin, urethane resin and synthetic rubber.

The protruding portion may be formed as a single unit with the housing. According to this structure, manufacturing of the protruding portion of the housing can be performed quickly and easily.

The protruding portion may be formed separately from the housing. According to this structure, the housing and the protruding portion can be manufactured separately and then assembled together to form the housing provided with the protruding portion.

An acoustic resistant material that adjusts the output of the playback sound may be provided in a section of the one surface of the housing that does not include the protruding portion. According to this structure, the air flow resistance of the acoustic resistant material can be increased or decreased to correct resonance, manufacturing characteristics, propensities of the housing and the like, thereby allowing playback sound quality to be adjusted.

The housing may be a supra-aural type housing that comes into contact with the outward facing surface of the auricle of the ear, or the housing may be a circumaural type housing that covers the whole of the auricle of the ear. According to these structures, the housing may be stably worn on the auricle without relying on elastic force of a neckband, a headband or the like that is connected to the housing of the supra-aural type housing or the circumaural type housing.

The headphone may further include a neckband having a ring shape with a partially cut-out section. In this structure, the neckband is connected at an inner side of at least one end thereof to the housing, and the housing has a generally flat surface that comes into contact with the outward facing surface of the auricle. A flat surface formed by the ring shape of the neckband is generally parallel with the generally flat surfaces of the housing, and the neckband has an elastic force that acts in a direction that causes the ring shape to return to the parallel arrangement. According to this structure, the neckband has a size that is compact and does not take up much space when not being used, and the shape of the neckband is simplified.

According to the embodiment of the present invention described above, movement of the housing is inhibited, stability of the headphone when worn is improved, and sound sensitivity is improved.

BRIEF DESCRIPTION OF THE DRAWING(S)

DETAILED DESCRIPTION OF THE PREFERRED EMBODIMENT(S)

Figure 1:
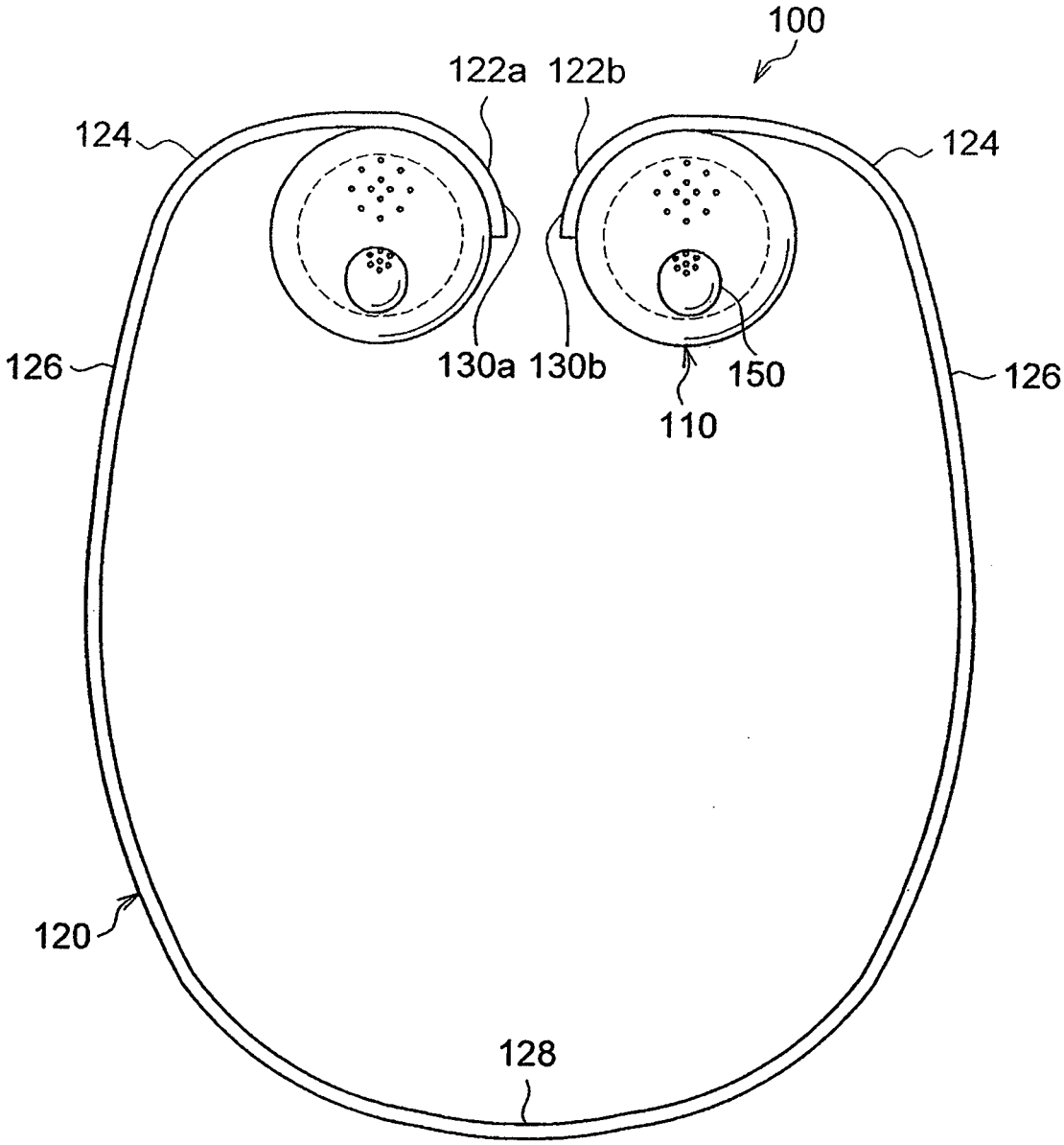
FIG. 1 is a plan view showing a headphone according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

First Embodiment

Figure 2:
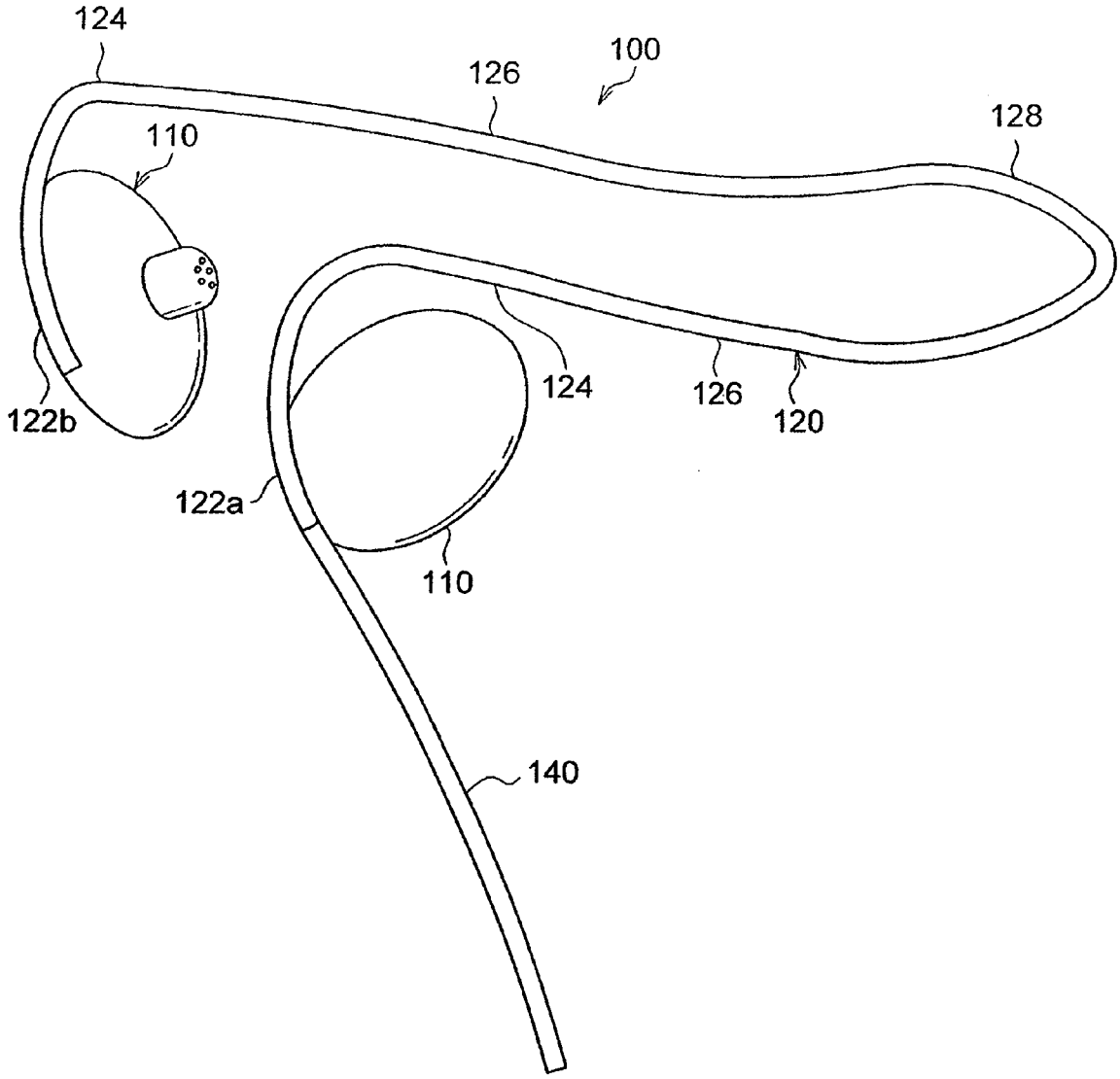
FIG. 2 is a perspective view showing the headphone according to the first embodiment.

First, a headphone 100 according to a first embodiment of the present invention will be explained. FIG. 1 is a plan view showing the headphone 100 according to the first embodiment. FIG. 2 is a perspective view showing the headphone 100 according to the first embodiment.

The headphone 100, as shown in FIG. 1 and FIG. 2, includes a pair of housings 110 with built in speaker units 116 (shown in FIG. 4) that output a playback sound, and a neckband 120 that is connected to the housings 110.

Figure 3:
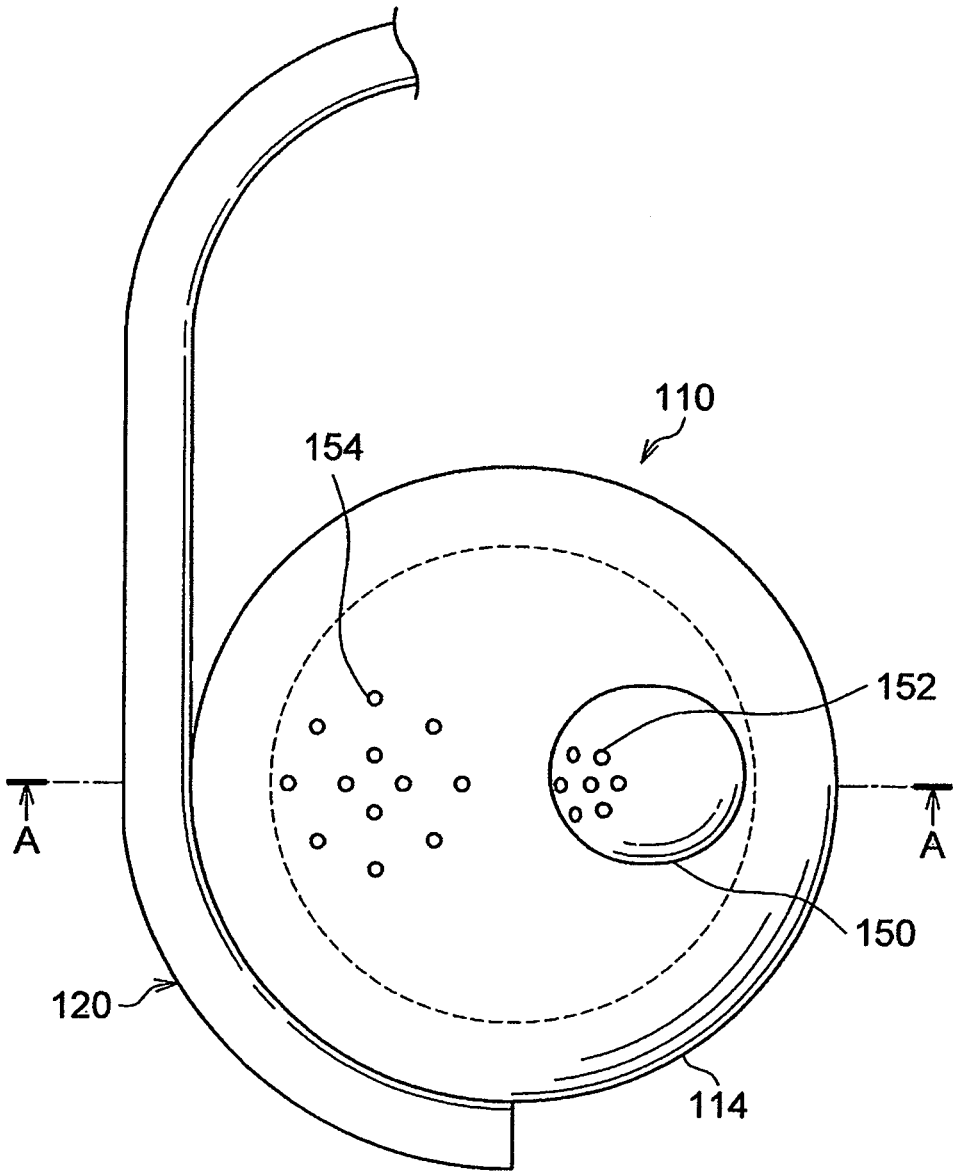
FIG. 3 is a plan view showing a housing according to the first embodiment.
Figure 4:
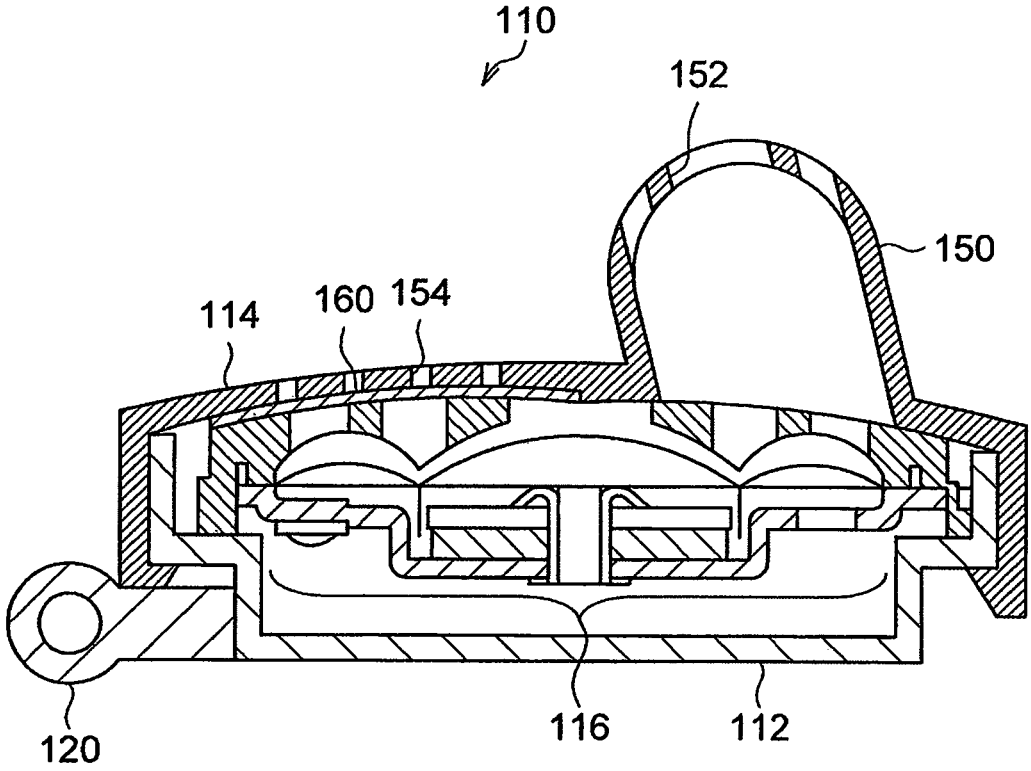
FIG. 4 is a cross sectional view of the housing according to the first embodiment along the line A-A of FIG. 3.
Figure 5:
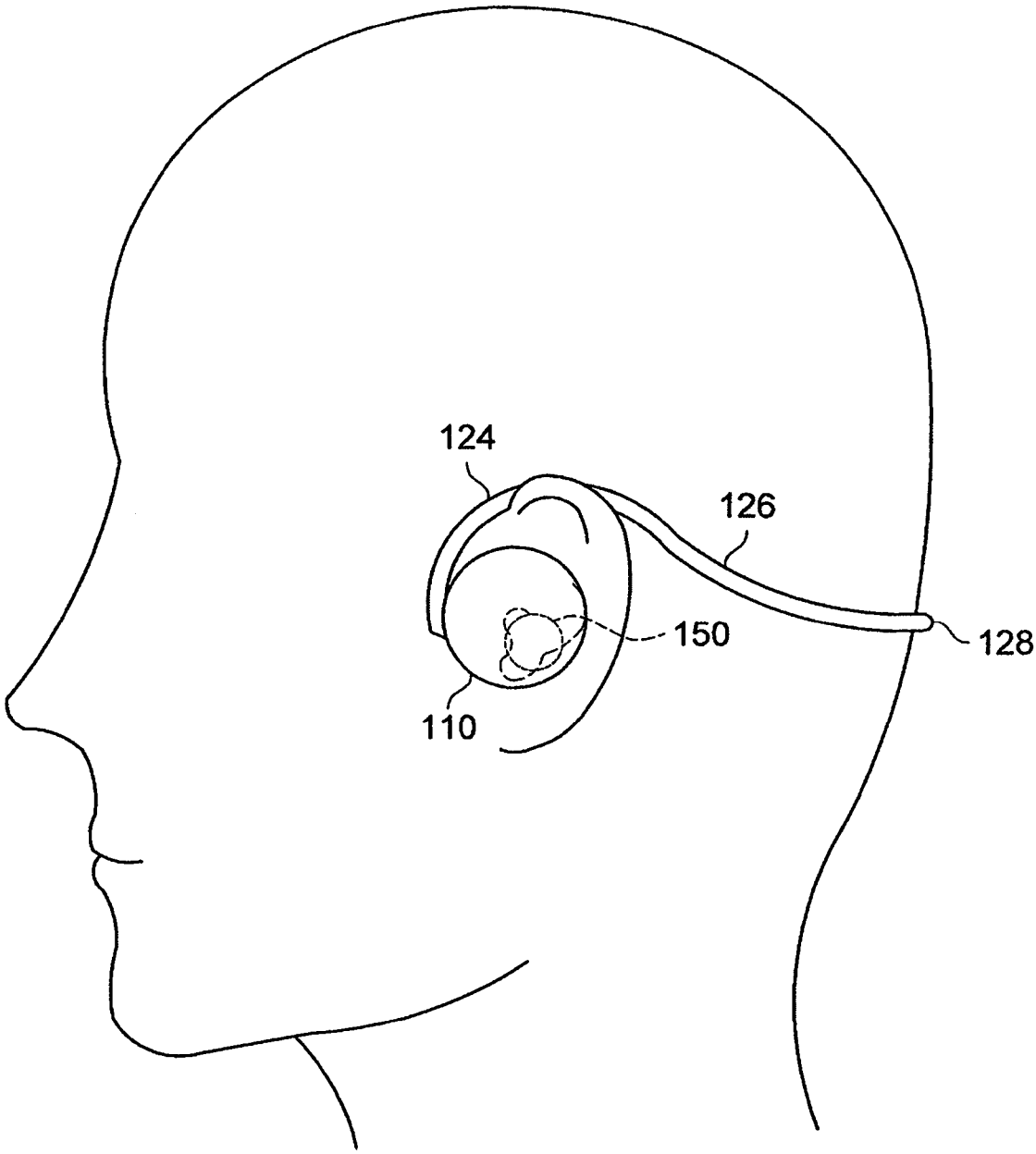
FIG. 5 is a side view showing the headphone according to the first embodiment when worn on a head.
Figure 6:
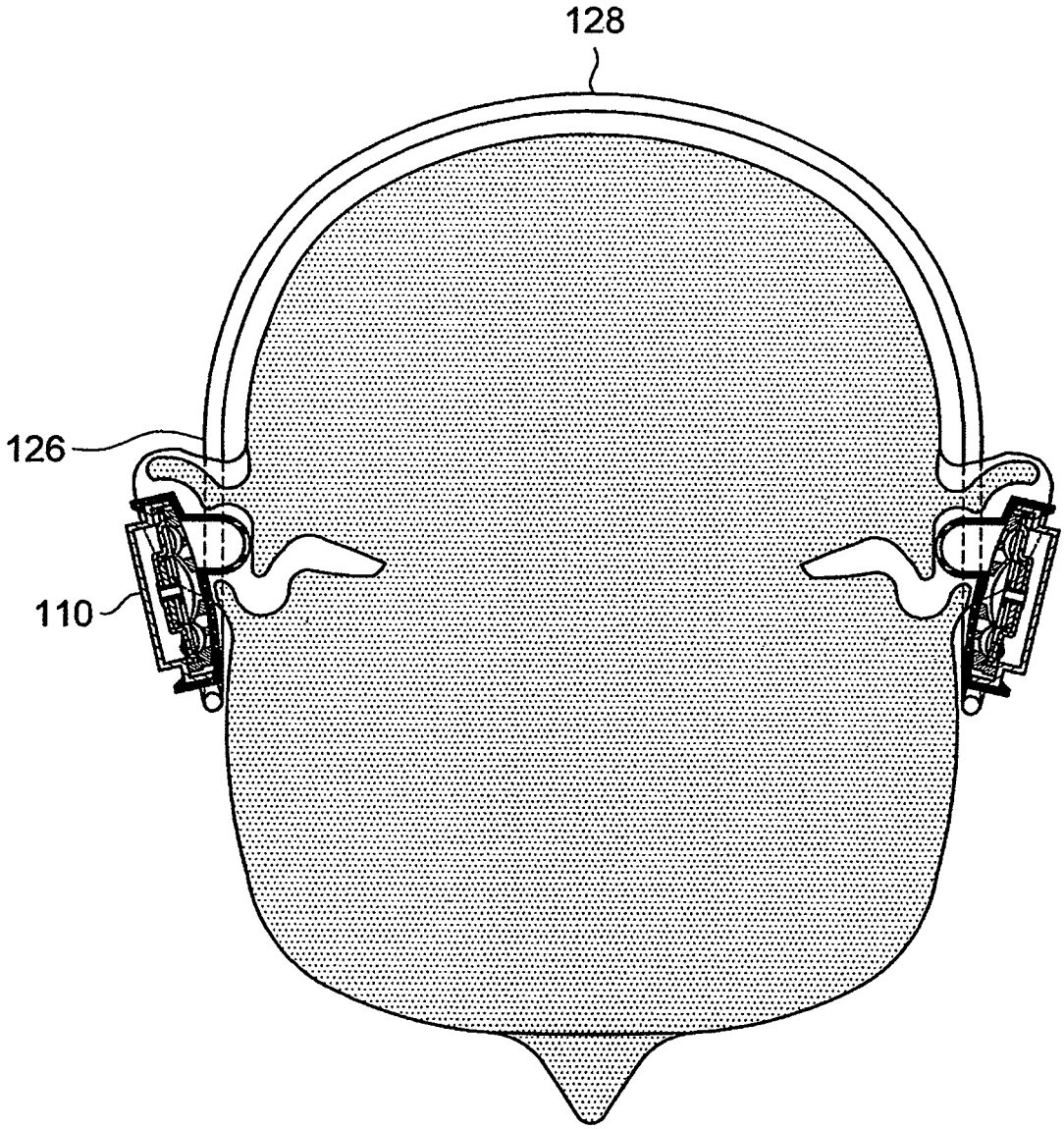
FIG. 6 is a cross sectional view showing a head wearing the headphone according to the first embodiment.
Figure 7:
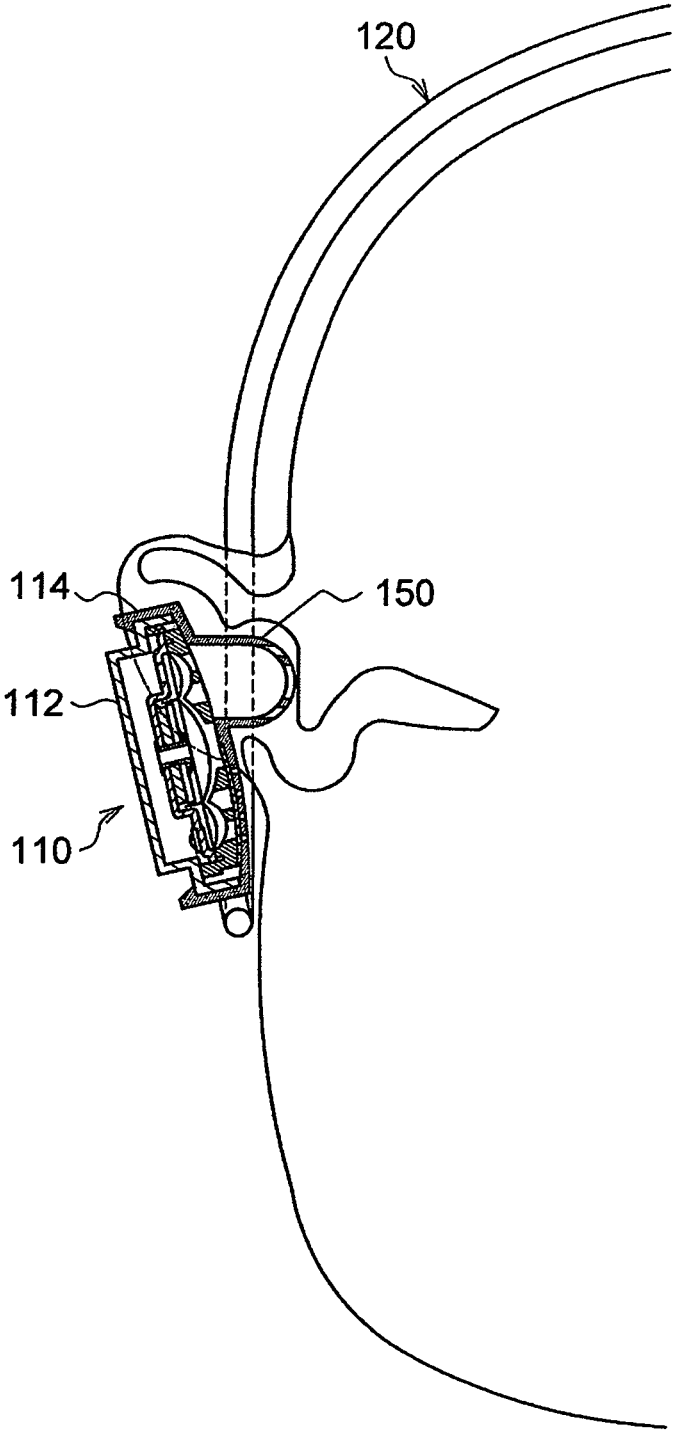
FIG. 7 is an expanded cross sectional view showing the section surrounding the auricle in an enlarged manner.

First, the housing 110 according to the first embodiment will be explained with reference to FIG. 1 to FIG. 6. (Although the device includes two housings 110, one for each ear, the following explanation will mainly focus on one of the housings 110 for the sake of explanatory simplicity). FIG. 3 is a plan view showing the housing 110 according to the first embodiment. FIG. 4 is a cross sectional view of the housing 110 according to the first embodiment along the line A-A of FIG. 3. FIG. 5 is a side view showing the headphone 100 according to the first embodiment when worn on a head. FIG. 6 is a cross sectional view showing a head wearing the headphone 100 according to the first embodiment. FIG. 7 is an expanded cross sectional view showing the section surrounding an auricle shown in FIG. 6 in an enlarged manner.

Figure 12:
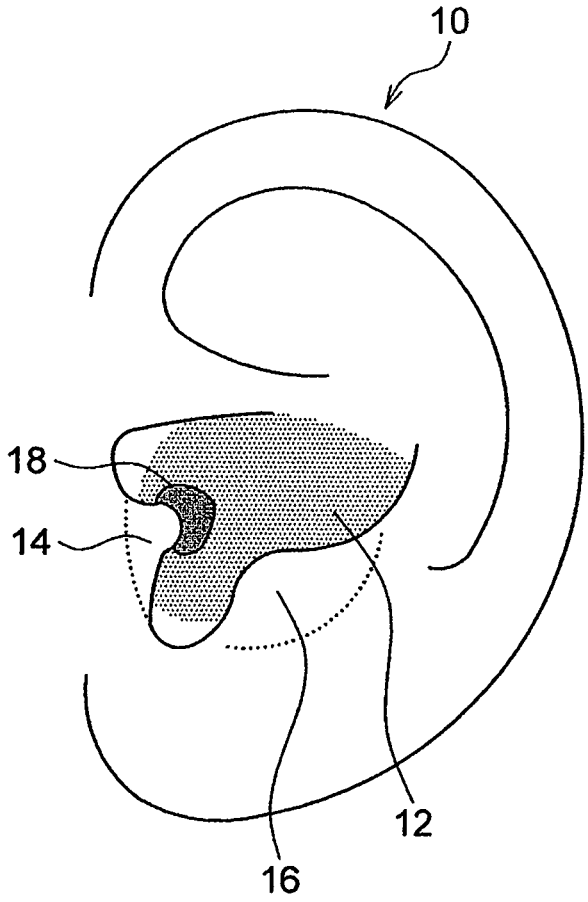
FIG. 12 is a front view showing a human auricle.

The housing 110, as shown in FIG. 3 and FIG. 4, is a case with a circular surface, and includes a body portion 112, a cover member 114, a speaker unit 116 and an acoustic resistant member 160. The headphone 100 according to the present embodiment is a supra-aural headphone that is positioned to come into contact with the outward facing surface of an auricle 10 (see FIG. 12). The housing 110 has a circular shape with a diameter of approximately 30 mm to 50 mm.

The body portion 112 contains the speaker unit 116 and is covered by the cover member 114. The side surface of the body portion 112 is connected to the neckband 120, and the neckband 120 positions the housing 110 on the head in a stable manner. When the headphone 100 is worn, the body portion 112 is positioned on the opposite side from the surface that comes into contact with the side of the auricle 10.

The body portion 112 includes a conducting wire 140. The conducting wire 140 is connected to a replay device (not shown in the figures) and connected to the speaker unit 116, and inputs a playback signal. Here, the speaker unit 116 and the replay device are described as being connected by a cable, but the invention is not limited to this example, and the speaker unit 116 may wirelessly receive the playback signal. In this case, the body portion 112 may include a receiving portion (not shown in the figures), a battery portion (not shown in the figures) and the like.

The cover member 114 covers the body portion 112, and a protruding portion 150 is formed in the cover member 114. The protruding portion 150 is formed integrally with the cover member 114. As a result of forming the members as an integrated unit, manufacturing of the cover member 114 is simplified and quicker. The section of the cover member 114 excluding the protruding portion 150 has, for example, a smooth and gently curving surface. When the headphone 100 is worn, as shown in FIG. 6 and FIG. 7, the section of the cover member 114 excluding the protruding portion 150 comes into contact with the peripheral area of a cavity of a concha 12 of the auricle 10. Also, aperture holes 154 may be formed in the section of the cover member 114 excluding the protruding portion 150. The aperture holes 154 link the interior and the exterior of the housing 110 so that they communicate with each other.

The protruding portion 150 is formed as a protruding shape in a specified area of one surface of the cover member 114. The protruding portion 150, as shown in FIG. 1 to FIG. 4, for example, protrudes in a cylindrical shape from one surface of the cover member 114, and is a hollow member with a curved leading edge. The protruding portion 150, for example, is formed with a diameter of 5 mm to 20 mm. As shown in FIG. 5 to FIG. 7, when positioned on the head, the protruding portion 150 is inserted into the cavity of the concha 12 (refer to FIG. 12). As a result of forming the protruding portion 150 on the housing 110 of the circumaural housing in this manner, the speaker unit 116 is positioned to the outside of the cavity of the concha 12.

The protruding portion 150, as shown in FIG. 3 and FIG. 4, may protrude at a slanting angle, and the angle of the slant can be any selected angle. By adjusting the angle of the slant, as shown in FIG. 6 and FIG. 7, the protruding portion 150 can be inserted adequately into the cavity of the concha 12 and can hold the housing 110 in position on the head.

The protruding portion 150 may be formed of an elastic material that has elasticity, or may be formed of a hard material that does not have elasticity. If an elastic material is used, the headphone 100 feels more flexible when worn, and the housing 110 can be held in place in the cavity of the concha 12 by the elasticity. Examples of the elastic material include materials like silicon resin, urethane resin, and synthetic rubber. Aperture holes 152 may be formed in the leading edge of the protruding portion 150. The playback sound generated by the speaker unit 116 can be output through the aperture holes 152.

The protruding portion 150 is provided on one of the surfaces of the housing 110. For example, as shown in FIG. 5, the protruding portion 150 may be provided on the lower side of the housing 110 and in a section of the housing 110 that is to the rear of the head when the headphone 100 is being worn on the head. As a result of providing the protruding portion 150 at this position, and inserting the protruding portion 150 in the cavity of the concha 12, the housing 110 can be worn in a balanced manner on the head.

The speaker unit 116 is housed in the body portion 112, inputs the playback signal from the replay device and outputs the playback sound. A general use speaker unit can be used as the speaker unit 116. A detailed explanation is omitted here.

The acoustic resistant member 160 is formed, for example, as a flat plate, and is formed, for example, from a non-woven fabric or urethane foam. By using the acoustic resistant member 160 to raise or lower the air-flow resistance, the resonance, product characteristics and the peculiarities and so on of the body portion 112 and the speaker unit 116 and the like can be corrected, and the sound quality of the playback sound can be adjusted.

The acoustic resistant member 160 is provided between the cover member 114 and the speaker unit 116. The acoustic material 160 may, for example, be provided in sections excepting the section corresponding to the protruding portion 150, or may be provided across all the interior sections of the cover member 114 including the section corresponding to the protruding portion 150, and the surface area can be changed according to the adjustment of the sound quality of the playback sound and the like.

Next, the neckband 120 according to the present embodiment will be explained with reference to FIG. 1, FIG. 2 and FIG. 5 to FIG. 7. When the headphone 100 is worn, the neckband 120 is placed so that it passes around the back of the head. The neckband 120 is a ring shape with a partially cut-out section or is generally C shaped. The neckband 120 includes curved portions with a further bow-shaped curve to the inner side in the vicinity of both ends 122*a* and 122*b*. The inner sides of the end 122*a* and the end 122*b* are connected to the respective housings 110.

When no external pressure is applied to the neckband 120, such as when it is not being worn, namely, when it is not in position on the head, the neckband 120 is generally coplanar with the flat surfaces of the housings 110 as shown in FIG. 1. Here, generally coplanar means that a flat surface that is formed by the ring shape of the neckband 120 is generally parallel with the generally flat surfaces of the housing 110. As shown in FIG. 2, the neckband 120 is placed on the head in a deformed condition where the housings 110 connected to the neckband 120 face each other. FIG. 5 to FIG. 7 show the headphone 100 in position on the head. As shown in FIG. 2, when the neckband is flexed due to external pressure, it has an elastic force that works in a direction to return it to the coplanar arrangement when it is not worn.

The neckband 120 is formed of an elastic material such as a synthetic resin, for example polybutyleneterephthalate (PBT) resin, polypropylene (PP) or the like. The neckband 120 is formed, for example, as a single-piece structure manufactured by injection molding using a die assembly.

The cross section of the neckband 120 may be, for example, an approximate circular shape or an elliptical shape, or may be a flat band shape. If the cross section of the neckband 120 is a circular shape, it can have a diameter of 4 mm, for example. The cross section of the neckband 120 may have a constant cross-sectional area from one end to the other end, or the shape may be partially changed, with sections having a different cross-sectional area. The neckband 120 may, for example, contain a built-in cord to transmit the replay signal. In order to contain the cord, a groove (not shown in the figures) may be formed along the full length of the neckband 120.

The neckband 120 as described above is formed as a single-piece structure, but it can be divided into the following major sections: sections 124 that are hooked over the auricle (hereinafter referred to as "auricle hooking over sections 124"), sections 126 that pass along the temporal region of the head (hereinafter referred to as "head temporal region sections 126"), and a section 128 that passes around the occipital region of the head (hereinafter referred to as the "head occipital region section 128"). Each of the components of the neckband 120 will be explained below.

The auricle hooking over sections 124 are the sections that curve to the inner side in the vicinity of the end 122*a* and the end 122*b* of the neckband 120, and have, for example, a bow shape with a radius of approximately 40 mm. The auricle hooking over sections 124 are formed as a pair. The auricle hooking over sections 124 are connected at one end to the housings 110, and the other end is continuously connected to the head temporal region sections 126. When the headphone 100 is worn, as shown in FIG. 5, the auricle hooking over sections 124 are passed between the auricle 10 surface that faces the temporal region of the head and the temporal region of the head and are hooked over the auricle 10.

The head temporal region sections 126 are the sections provided on both sides of the headphone 100. For example, they have a straight line shape of approximately 100 mm or a curved line shape with a moderate curvature. The head temporal region sections 126 are formed as a pair. The head temporal region sections 126 are connected at one end to the auricle hooking over sections 124, and the other end is continuously connected to the head occipital region section 128. When the headphone 100 is worn, as shown in FIG. 5 to FIG. 7, the head temporal region sections 126 are positioned along the temporal regions of the head so that they are in close proximity to the temporal regions of the head.

The head occipital region section 128 is a section provided on one side of the headphone 100, and is, for example, a bow shape of a generally half-arc shape with a radius of approximately 60 mm. The head occipital region section 128 has a larger curvature than the auricle hooking over sections 124. Each end of the head occipital region section 128 is continuously connected to each of the head temporal region sections 126. When the headphone 100 is worn, as shown in FIG. 5 to FIG. 7, the head occipital region section 128 is positioned along the occipital region of the head, so that it is in close proximity to the occipital region of the head.

The headphone 100 may further include coupling members 130*a* and 130*b*. The coupling members 130*a* and 130*b* are provided on each of the ends 122*a* and 122*b* of the neckband 120. The coupling members 130*a* and 130*b* are coupled to each other.

When it is not being worn, the headphone 100 has a shape as shown in FIG. 1, with the ends 122*a* and 122*b* of the neckband 120 in proximity to each other. By providing a coupling member 130*a* and a coupling member 130*b* respectively on each of the sections where the ends 122*a* and 122*b* of the neckband 120 come into contact with each other, the ends 122*a* and 122*b* can be connected, allowing the neckband 120 to be generally coplanar with the housing 110 during storage. As a result of adopting the above-described structure, the neckband 120 has a size that is compact and does not take up much space when not being worn, and the shape of the neckband 120 is simplified.

Figure 8:
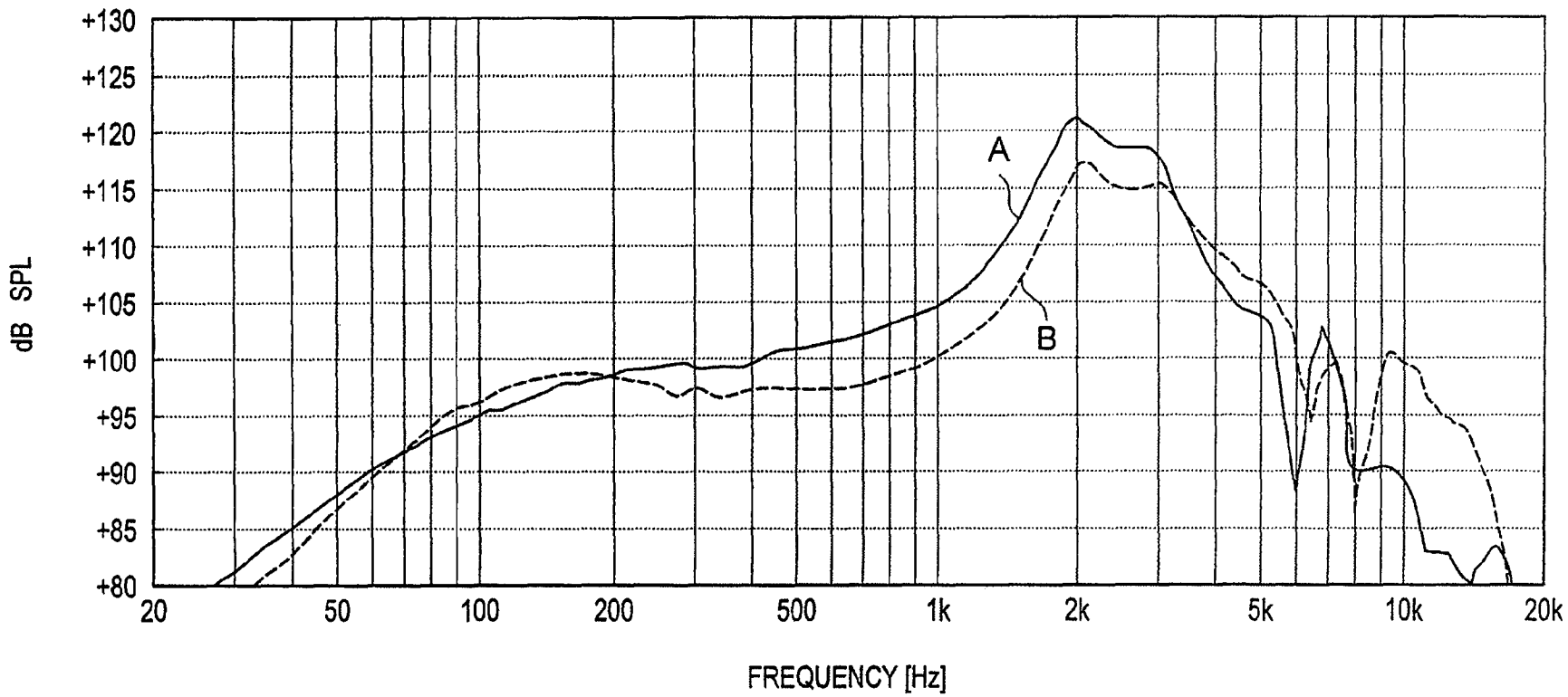
FIG. 8 is an explanatory figure showing the waveform characteristics of the headphone of the first embodiment and the waveform characteristics of a known headphone.

Next, the movement of the headphone 100 according to the present embodiment will be explained. FIG. 8 is an explanatory figure showing the frequency characteristics of the headphone 100 of the first embodiment and the frequency characteristics of a known headphone. The headphone 100 of the present embodiment that includes the protruding portion 150 is shown by the solid line A, and the known headphone that does not include the protruding portion 150 is shown by the dotted line B.

As can be understood from FIG. 8, the response of the headphone 100 of the present embodiment is high, and because the protruding portion 150 is inserted in to the cavity of the concha 12, loss of sound from the housing 110 is reduced as compared to the known headphone.

Second Embodiment

Figure 9:
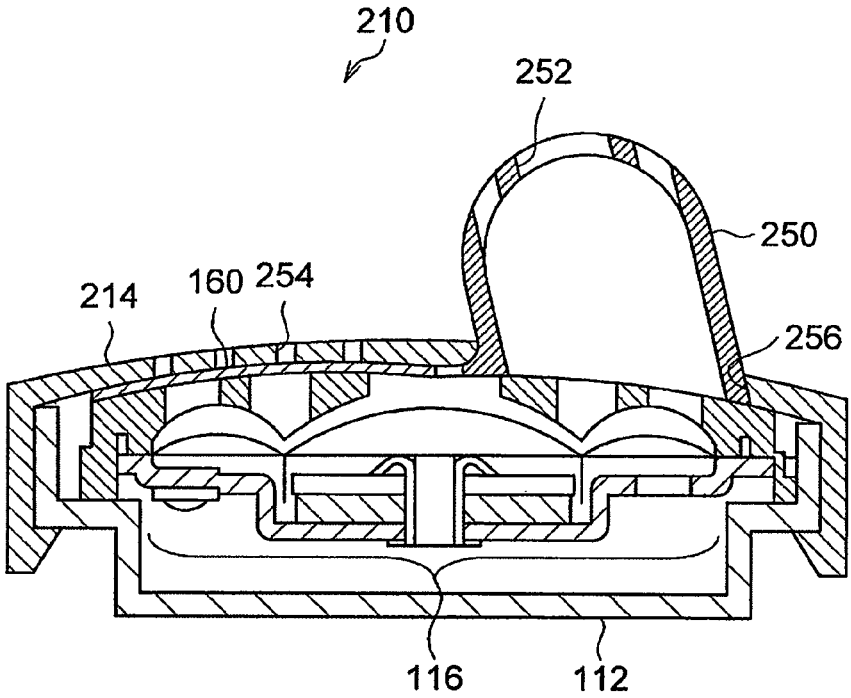
FIG. 9 is a cross sectional view showing a housing of a second embodiment of the invention.

Next, the structure of a headphone 200 according to a second embodiment of the present invention will be explained. FIG. 9 is a cross sectional view showing a housing 210 of the second embodiment. The headphone 200 of the present embodiment, like that of the first embodiment, is a supra-aural headphone in which the housing 210 is positioned to come into contact with the outward facing surface of the auricle 10 (see FIG. 12).

Only the structure of the housing in the second embodiment is different to that of the first embodiment, and thus the explanation given here will focus on the housing 210.

The housing 210 is a case with a circular surface like the housing 110 of the first embodiment. The housing 210 has a circular shape with a diameter of approximately 30 mm to 50 mm. The housing 210 includes the body portion 112, a cover member 214, a protruding portion 250, the speaker unit 116 and the acoustic resistant member 160. Note that, the protruding portion 250 is one example of a protruding portion. In addition, since the body portion 112, the speaker unit 116, and the acoustic resistant member 160 have the same structure as the first embodiment, a detailed explanation of these members will be omitted here.

The cover member 214 covers the body portion 112. Unlike the cover member 114 of the first embodiment, the cover member 214 and the protruding portion 250 are formed as separate members. As a result, of forming the cover member 214 and the protruding portion 250 as separate members, the housing and the protruding portion can be manufactured separately, and assembled together to form a housing that includes a protruding portion. An aperture hole 256 is formed in the section of the cover member 214 that includes the protruding portion 250, namely, the aperture hole 256 is formed in a specified area of one surface of the cover member 214. The cover member 214 has, for example, a smooth and gently curving surface. When the headphone 200 is worn, the cover member 214 comes into contact with the peripheral area of the cavity of the concha 12 of the auricle 10. Also, aperture holes 254 may be formed in the cover member 214. The aperture holes 254 link the interior and the exterior of the housing 210 so that they communicate with each other.

The protruding portion 250 passes through the aperture hole 256 provided in the specified area of the one surface of the cover member 214, and protrudes toward the outside from the housing 210. An end of the protruding portion 250 at the housing 210 side is inserted in to the inside of the housing 210 such that the protruding portion 250 is fixed to the cover member 214 and cannot detach to the outside.

The protruding portion 250 protrudes in a cylindrical shape as shown in FIG. 9, and is a hollow member with a curved leading edge. The protruding portion 250, for example, is formed with a diameter of 5 mm to 20 mm. When positioned on the head, the protruding portion 250 is inserted into the cavity of the concha 12 (refer to FIG. 12) like the protruding portion 150 of the first embodiment.

The protruding portion 250, as shown in FIG. 9, may protrude at a slanting angle, and the angle of the slant can be any selected angle. By adjusting the angle of the slant, the protruding portion 250 can be inserted adequately into the cavity of the concha 12 and can hold the housing 110 in position on the head.

The protruding portion 250 may be formed of an elastic material that has elasticity, or may be formed of a hard material that does not have elasticity. If an elastic material is used, the headphone 200 feels more flexible when worn, and the housing 210 can be held in place in the cavity of the concha 12 by the elasticity. Aperture holes 252 may be formed in the leading edge of the protruding portion 250. The playback sound generated by the speaker unit 116 can be output through the aperture holes 252.

Third Embodiment

Figure 10:
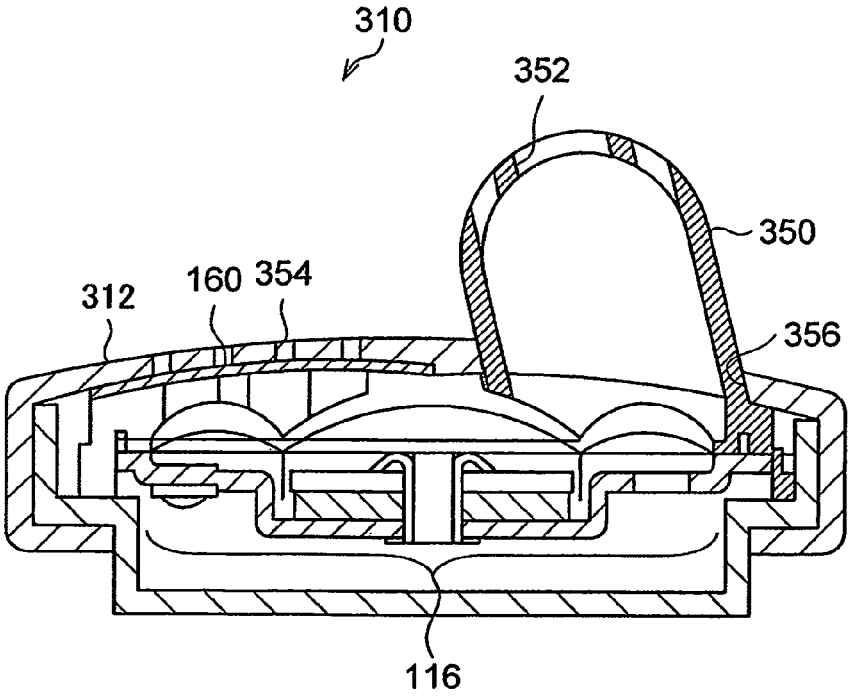
FIG. 10 is a cross sectional view showing a housing of a third embodiment of the invention.

Next, the structure of a headphone 300 according to a third embodiment of the present invention will be explained. FIG. 10 is a cross sectional view showing a housing 310 of the third embodiment. The headphone 300 of the present embodiment, like that of the first embodiment, is a supra-aural headphone in which the housing 310 is positioned to come into contact with the outward facing surface of the auricle 10 (see FIG. 12).

Only the structure of the housing in the third embodiment is different to that of the first embodiment, and thus the explanation given here will focus on the housing 310.

The housing 310 is a case with a circular surface like that of the housing 110 of the first embodiment. The housing 310 has a circular shape with a diameter of approximately 30 mm to 50 mm. The housing 310 includes a body portion 312, a protruding portion 350, the speaker unit 116 and the acoustic resistant member 160. Since the speaker unit 116 and the acoustic resistant member 160 have the same structure as the first embodiment, a detailed explanation of these members will be omitted here.

The body portion 312 includes the body portion 112 and the cover member 114 of the first embodiment as an integrated unit, with the speaker unit 116 housed therein.

The body portion 312 is formed separately from the protruding portion 350. An aperture hole 356 is formed in the section of the body portion 312 that includes the protruding portion 350, namely, the aperture hole 356 is formed in a specified area of one surface of the body portion 312. The side of the body portion 312 that faces the auricle 10 has, for example, a smooth and gently curving surface. When the headphone 300 is worn, the body portion 312 comes into contact with the peripheral area of the cavity of the concha 12 of the auricle 10. Also, aperture holes 354 may be formed in the body portion 312. The aperture holes 354 link the interior and the exterior of the housing 310 so that they communicate with each other.

The protruding portion 350 passes through the aperture hole 356 provided in the specified area of the one surface of the body portion 312, and protrudes toward the outside from the housing 310. An end of the protruding portion 350 at the housing 310 side is inserted in to the inside of the housing 310 such that the protruding portion 350 is fixed to the body portion 312 and cannot detach to the outside, as shown in FIG. 10. The shape, material of the protrusion of the protruding portion 350 are the same as those of the protruding portion 250 of the above-described second embodiment, and thus a description will be omitted here. Aperture holes 352 may be formed in the leading edge of the protruding portion 350. The playback sound generated by the speaker unit 116 can be output through the aperture holes 352.

It should be understood by those skilled in the art that various modifications, combinations, sub-combinations and alterations may occur depending on design requirements and other factors insofar as they are within the scope of the appended claims or the equivalents thereof.

For example, in the above-described embodiments, when not being worn, the neckband 120 is arranged to be generally coplanar with the flat surfaces of the housings 110, 210, 310. However, when worn, the neckband 120 is placed on the head in a deformed shape that matches the head. However, the invention is not limited to these examples. For example, the neckband 120 may be formed with a three dimensional shape that matches the head, and maintain generally the same shape when worn and when not worn.

Figure 11:
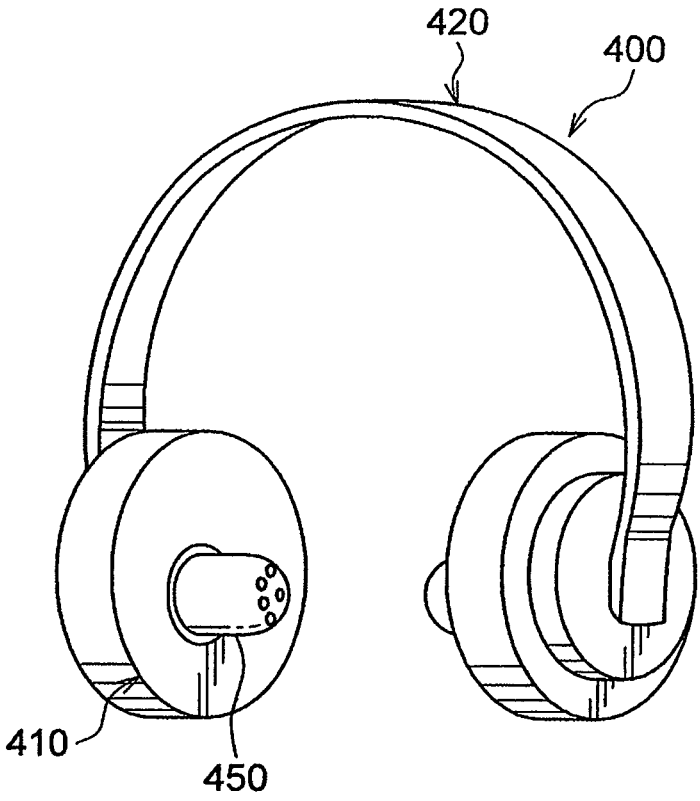
FIG. 11 is a perspective view that shows a modified example of a headphone of an embodiment of the invention.

In addition, For example, in the above-described embodiments, each of the headphones 100, 200, 300 includes the neckband 120 that is connected with each of the housings 110, 210, 310. However, the invention is not limited to these examples. For example, as shown in FIG. 11, the invention may be applied as a headphone 400 that includes a headband 420 that is connected with a housing 410 and that passes around the periphery of the top of the head when the headphone 400 is worn. A protruding portion 450 that has generally the same structure as the above-described protruding portions 150, 250, 350 may be formed in the housing 410.

In this modified example, in a similar way to when the band section of the headphone is a neckband, the protruding portion 450 may be inserted in the cavity of the concha 12, thereby inhibiting movement of the housing 410, improving stability of the worn device, and improving sound sensitivity.

Furthermore, in the above-described embodiments, examples are explained in which the housings 110, 210 and 310 are supra-aural headphones. However, the present invention is not limited to these examples. For example, the housing may be a circumarual housing. In this case, the protruding portion is formed to protrude from one surface of the housing.

What is claimed is:

1. A headphone comprising:

a housing that includes a speaker unit, and a protruding portion that is provided so as to protrude at a specified position on one surface of the housing and to output a playback sound from the speaker unit, the protruding portion protruding at an angle from the one surface, the protruding portion being formed of an elastic material, wherein the headphone is adapted for wearing on a head so that:

the one surface of the housing comes into contact with an outward facing surface of an auricle surrounding a cavity of a concha, the protruding portion extends into the cavity of the concha without entering an auditory canal, and the protruding portion protrudes from a section of the housing that is disposed closer to a back of the head than another section of the housing, and closer to a bottom of the head than the other section of the housing, when viewed from a direction along which the protruding portion extends into the cavity of the concha.

2. The headphone according to claim 1, wherein the protruding portion is formed of one of silicon resin, urethane resin, and synthetic rubber.

3. The headphone according to claim 1, wherein the protruding portion is formed as a single unit with the housing.

4. The headphone according to claim 1, wherein the protruding portion is formed separately from the housing.

5. The headphone according to claim 1, wherein an acoustic resistant material that adjusts the output of the playback sound is provided in a section of the one surface of the housing that does not include the protruding portion.

6. The headphone according to claim 1, wherein the housing is a supra-aural type housing that comes into contact with the outward facing surface of the auricle of the ear.

7. The headphone according to claim 1, wherein the housing is a circumaural type housing that covers the whole of the auricle of the ear.

8. The headphone according to claim 1, further comprising:

a neckband having a ring shape with a partially cut-out section, the neckband being connected at an inner side of at least one end thereof to the housing, wherein the housing has a generally flat surface that comes into contact with the outward facing surface of the auricle of the ear, a flat surface formed by the ring shape of the neckband is generally parallel with the generally flat surface of the housing, and the neckband has an elastic force that acts in a direction that causes the ring shape to return to the parallel arrangement.

9. The headphone according to claim 1, further comprising a band adapted to exert an elastic force which, when the headphone is worn on the head, causes the one surface of the housing to come into contact with a peripheral area of the cavity of the concha.

* * * * *